US005942702A

United States Patent [19]

Inoue

[11] Patent Number: 5,942,702

[45] Date of Patent: Aug. 24, 1999

[54] KEYBOARD MUSICAL INSTRUMENT HAVING FALL-BOARD ASSEMBLED WITH CASE BY MEANS OF OLDHAM'S COUPLING

[75] Inventor: Satoshi Inoue, Hamamatsu, Japan

[73] Assignee: Yamaha Corporation, Shizuoka-ken, Japan

[21] Appl. No.: 09/128,777

[22] Filed: Aug. 4, 1998

[30] Foreign Application Priority Data

Aug. 6, 1997 [JP] Japan ..... 9-211880

[51] Int. Cl.[6] ..... G10C 3/02

[52] U.S. Cl. ..... 84/179

[58] Field of Search ..... 84/177–179, DIG. 3, 84/DIG. 17

[56] References Cited

U.S. PATENT DOCUMENTS 5,635,655 6/1997 Yamashita ..... 84/179

FOREIGN PATENT DOCUMENTS 63-55592 3/1988 Japan .
5-48238 12/1993 Japan .

*Primary Examiner*—Stanley J. Witkowski
*Attorney, Agent, or Firm*—Hazel & Thomas, P.C.

[57] ABSTRACT

An upright piano includes a fall-board hinged to a upper sill and connected through a pair of flexible coupling to side arms, and each of the flexible couplings has a rotary damper embedded in the side arm and an Oldham's coupling connected between the fall-board and the rotary damper so that the Oldham's couplings take up misalignment between the rotational axis of the fall-board and the rotational axes of the rotary dampers.

8 Claims, 5 Drawing Sheets

KEYBOARD MUSICAL INSTRUMENT HAVING FALL-BOARD ASSEMBLED WITH CASE BY MEANS OF OLDHAM'S COUPLING

FIELD OF THE INVENTION

This invention relates to a keyboard musical instrument such as a piano and, more particularly, to a keyboard musical instrument having a fall-board assembled with a case by means of a pair of couplings.

DESCRIPTION OF THE RELATED ART

A keyboard is an indispensable component of the keyboard musical instrument, and is accommodated in a stationary case. A fall-board is assembled with the stationary case, and protects the keyboard against undesirable damages. The fall-board is turnable between a closed position and an open position, and a suitable coupling is provided between the stationary case and the fall-board. The fall-board in the open position exposes the keyboard to a player, and allows the player to finger on the keyboard. On the other hand, when the fall-board is changed to the closed position, the keyboard is covered with the fall-board, and undesirable impact does not damage the keyboard.

Various couplings have been proposed. A typical example is disclosed in Japanese Utility Model Publication of Examined Publication No. 5-48238, and FIG. 1 illustrates the prior art rotary damper disclosed therein. Although a pair of prior art rotary dampers 1 is provided between a fall-board 2 and a pair of side arms 3, only one prior art rotary damper 1 is shown in FIG. 1 together with part of the fall-board 2 and the associated side arm 3.

The prior art rotary damper is broken down into an oil damper 1*a* and a connector 1*b*. The oil damper 1*a* includes a cylinder 1*c* filled with oil and a rotary member 1*d* inserted into the cylinder 1*c*. The cylinder 1*c* is embedded into the side arm 3, and is fixed to the side arm 3 by means of a plate 1*e*. Thus, the cylinder 1*c* is stationary with respect to the side arm 3. The rotary member 1*d* is rotatable with respect to the cylinder 1*c*, and the oil offers viscous resistance against the rotating motion of the rotary member 1*d*. A cubic projection If is formed on the top surface of the rotary member 1*d*. On the other hand, the connector 1*b* is attached to a side surface of the fall-board 2, and slit 1*g* is formed between projections 1*h*.

When the fall-board 2 is assembled with the side arms 3, an erector aligns the slit 1*g* with the cubic projection 1*f* on both sides of the fall-board 2, and inserts the cubic projections If into the associated slits 1*g*, respectively. The fall-board 2 is supplied through the rotary dampers 1 by the side arms 3, and the rotary dampers 1 allow the fall-board to turn between the closed position and the open position. The viscous resistance against the motion from the closed position to the open position is weak, and the player easily rotates the fall-board to the open position. While the fall-board is moving from the open position to the closed position, the rotary dampers 1 gradually increase the viscous resistance, and assist the player so as to prevent the fall-board from collision against the key slip.

The prior art rotary damper is appropriate for the fall-board of a grand piano, because the manufacturer easily aligns the axes of rotation of the prior art rotary dampers with the axis of rotation of the fall-board. However, it is difficult to use the prior art rotary damper in an upright piano. In detail, the fall-board of an upright piano is usually hinged to the upper sill, and, accordingly, the hinge is as long as the fall-board. If the prior art rotary dampers are inserted between the side surfaces of the fall-board and the side arms for the damping effect against the motion from the open position to the closed position, it is necessary to precisely align the rotational axis of the hinge with the rotational axes of the rotary dampers. If the axis is offset from the axes, the fall-board exerts bending moment on the rotary member 1*d* during the rotating motion between the closed position and the open position, and the prior art rotary damper is broken. Otherwise, the piano case is broken. If the fall-board of the upright piano is supported by means of the pair of prior art rotary dampers without the hinge, the serious bending moment is never exerted on the rotary members 1*d*. However, the fall-board of an upright piano is not so rigid as the fall-board of a grand piano. If the fall-board is not hinged, the fall-board is downwardly deformed due to aged deterioration, and the external appearance is degraded. This means that the hinge is indispensable for the upright piano. Thus, the prior art rotary damper is difficult to use.

Another problem inherent in the prior art rotary damper is that the margin of misalignment is negligible. The rotary member 1*d* and the connector 1*b* are coupled through the small projection and the narrow slit 1*g*. This means that the rotational axis of the fall-board is surely aligned with the rotational axes of the prior art rotary dampers 1. This requirement results in a hard assembly work, because an erector is required to keep the heavy fall-board at the aligning position without obliquity and jogs. When the erector assembles the fall-board with the piano case, a suitable jig may be available for the assemblage. Moreover, even though the jig is available, the accurate alignment between the rotational axis of the fall-board and the rotational axes of the rotary dampers requires difficult work for the erectors. Thus, the assembling work under the small margin is hard for the erectors.

Another prior art rotary damper disclosed in Japanese Patent Publication of Unexamined Application No. 63-55592 has a pair of gears. The gears are respectively connected to the rotary member and a projection of the connector, and are meshed with each other. A pair of gears allows the connector and, accordingly, the fall-board to turn around the rotary member, and takes up the offset between the rotational axis of the fall-board and the rotational axes of the rotary members. However, the pair of gears merely takes up extremely small offset. In other words, the margin for the assemblage is extremely small, and the assembling work is still hard for the erectors. Thus, the prior art rotary damper disclosed in the Japanese Patent Publication of Unexamined Application is not available for the upright piano due to the production cost and the difficulty in the assembling work.

SUMMARY OF THE INVENTION

It is therefore an important object of the present invention to provide a keyboard musical instrument, which has a fall-board connected to a case by means of economical flexible couplings.

To accomplish the object, the present invention proposes to use an Oldham's coupling as the economical flexible couplings.

In accordance with one aspect of the present invention, there is provided a keyboard musical instrument comprising a case having an opening, a keyboard supported by the case and exposed to the opening, a fall-board assembly changed between an open position for exposing the keyboard to a player and a closed position for covering the keyboard, a pair of rotary dampers attached to one of the fall-board assembly and the case and offering resistance against a rotating motion of the fall-board assembly from the open position to the closed position and a flexible coupling including a pair of Oldham's couplings connected between the other of the fall-board assembly and the case and the pair of rotary dampers.

BRIEF DESCRIPTION OF THE DRAWINGS

The features and advantages of the keyboard musical instrument will be more clearly understood from the following description taken in conjunction with the accompanying drawings in which.

DESCRIPTION OF THE PREFERRED EMBODIMENT

Figure 2:
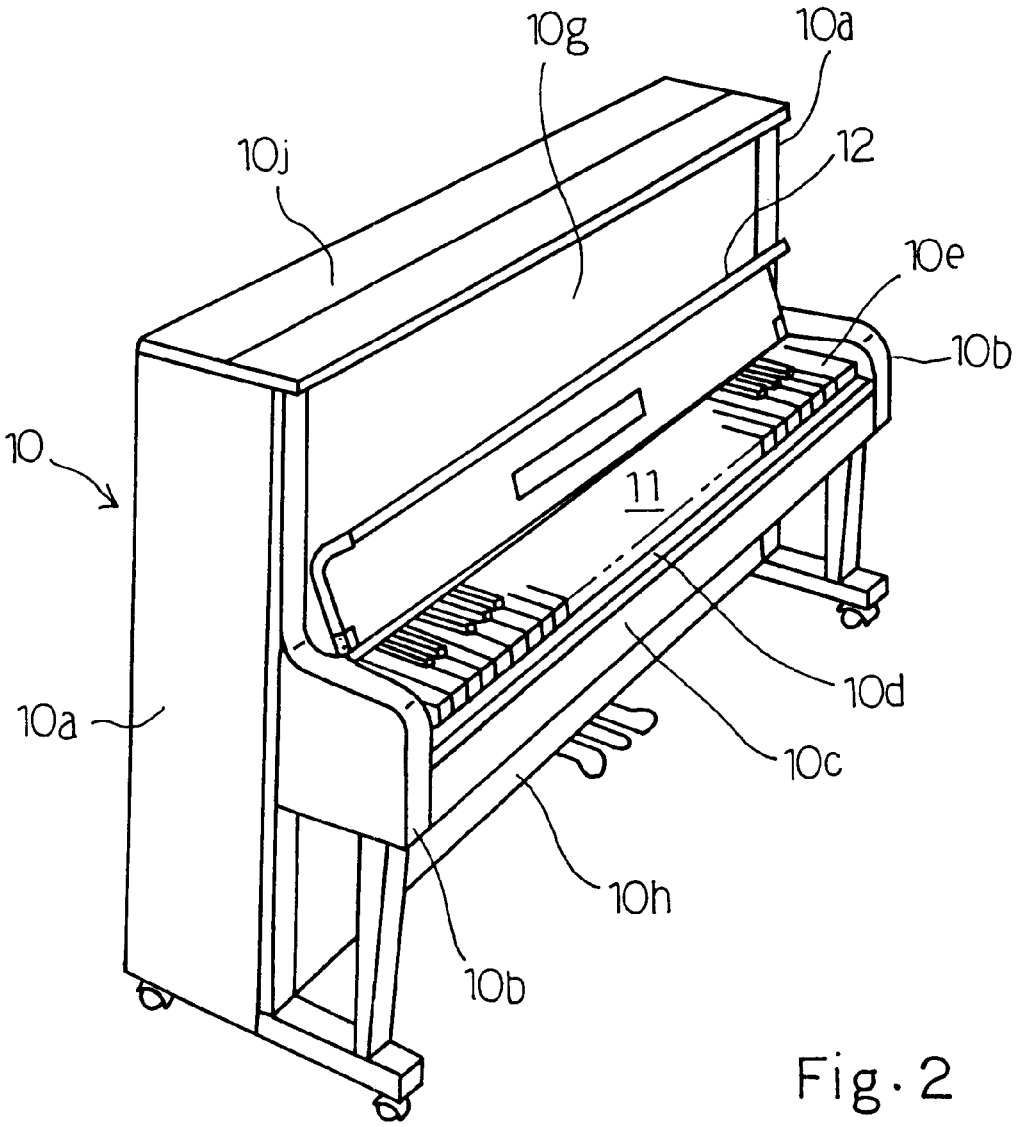
FIG. 2 is a perspective view showing an upright piano according to the present invention.
Figure 3:
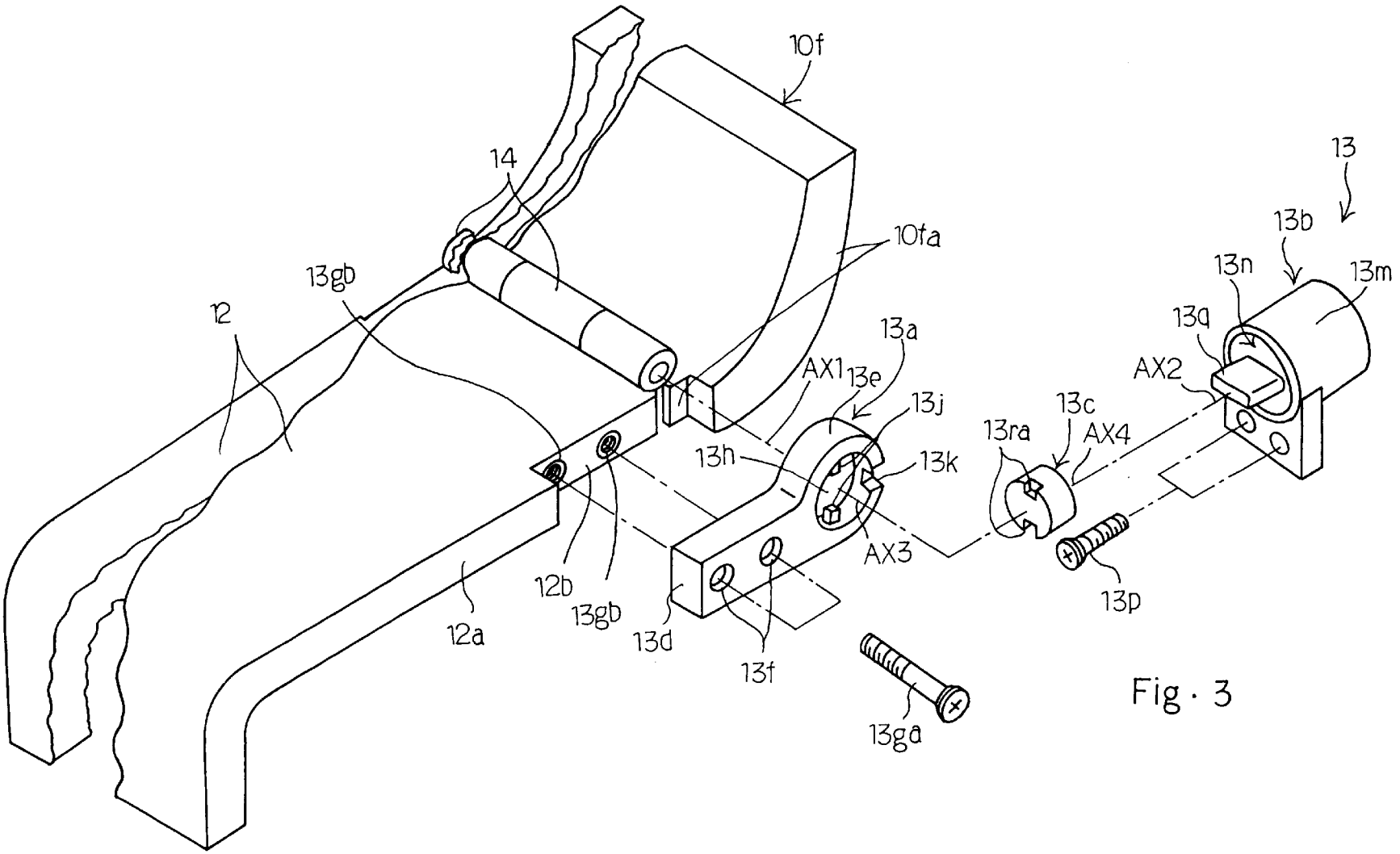
FIG. 3 is a perspective view showing a flexible coupling used in the upright piano in disassembled state.
Figure 4:
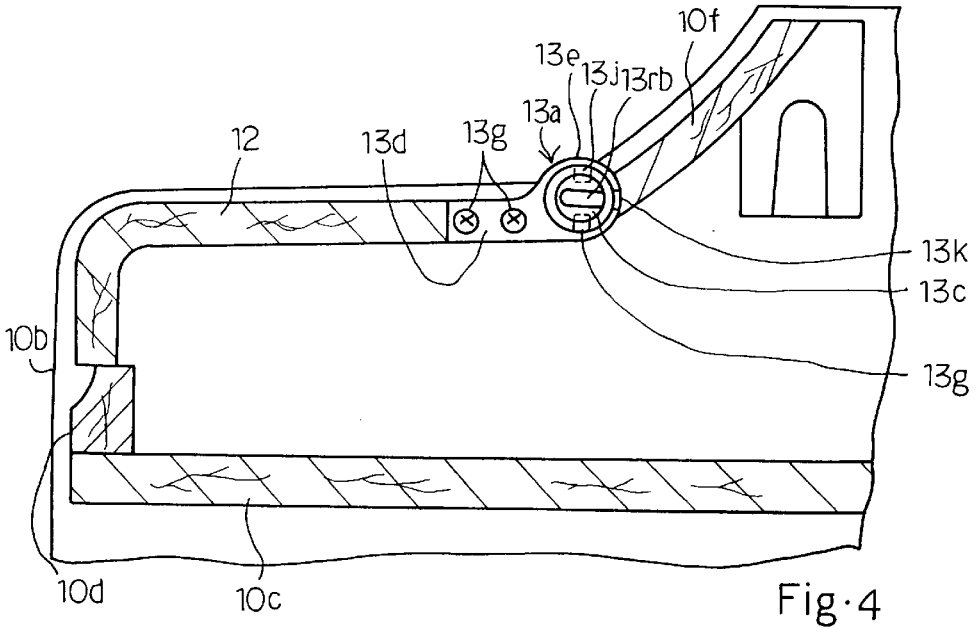
FIG. 4 is a side view showing essential part of the flexible coupling attached to a fall-board.

Referring to FIGS. 2, 3 and 4 of the drawings, an upright piano embodying the present invention largely comprises a piano case structure 10, a keyboard 11 accommodated in the piano case structure 10, plural sets of strings (not shown) stretched inside the piano case, key action mechanisms (not shown) and hammer assemblies (not shown) installed inside the piano case structure 10 and functionally connected to the keyboard 11 for striking the sets of strings and a fall-board 12 turnably connected to the piano case structure 10. The fall-board 12 is moved between a closed position and an open position. The fall-board 12 in the closed position is substantially horizontal, and covers the keyboard 11. The fall-board 12 turns over 120 degrees to 130 degrees, and reaches the open position. The fall-board 12 in the open position exposes the keyboard 11 to a player as shown in FIG. 2. The keyboard 11, the key action mechanisms, the hammer assemblies and the strings are well known to person skilled in the art, and no further description is incorporated hereinbelow. In the following description, term "front" means a position closer to a player fingering on the keyboard 11.

The piano case structure 10 includes two side boards 10*a* spaced from each other, two side arms 10*b* respectively projecting from the side boards 10*a* toward the front side, a key bed 10*c* laterally extending between the side arms 10*b*, a key slip 10*d* laterally extending on the key bed and two key blocks 10*e*. The keyboard 11 is mounted on the key bed 10*c*, and the key slip 10*d* is provided in front of the keyboard 11. The key blocks 10*e* are provided on the key bed 10*c* between the keyboard 11 and the side arms 10*b*.

Figure 1:
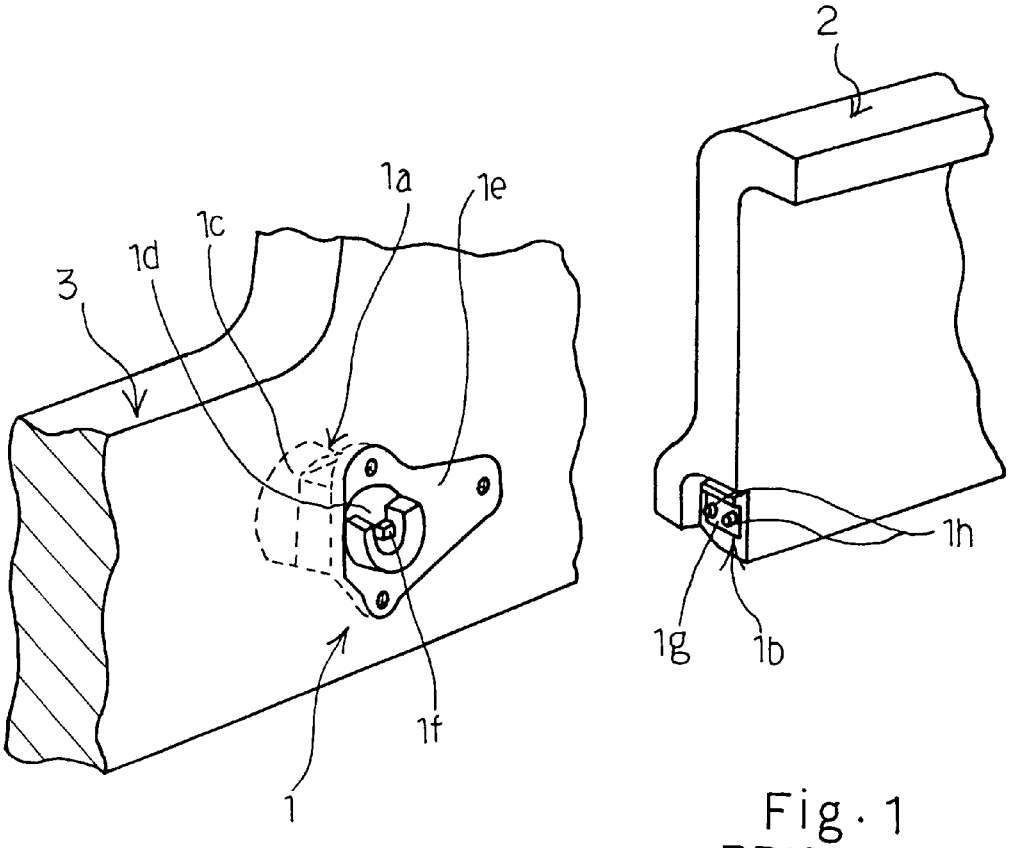
Fig. 1 PRIOR ART
FIG. 1 is a perspective view showing the prior art rotary damper in the disassembled state.

The piano case structure 10 further includes a key stop rail (not shown), an upper sill 10*f* (see FIG. 3), an upper front board 10*g*, a lower front board 10*h* and a top board 10*j*. The key stop rail (not shown) covers the rear portion of the keyboard 11, and the upper sill 10*f* is continued. As will be described hereinbelow, the fall-board 12 is hinged to the upper sill 10*f*. The upper front board 10*f* extends between the side boards 10*a* over the upper sill 10*f*, and the lower front board 10*h* extends between the upper surfaces of side boards 10*a* under the key bed 10*c*. The top board 10*j* extends between the side boards 10*a*, and closes the upper opening. Although back posts, a sound board and other boards are further incorporated in the piano case, they are not shown in FIG. 1.

The upright piano further comprises a pair of flexible couplings 13 (see FIG. 3) provided between the side arms 10*b* and the fall-board 12 and a hinge, 14 connected between the upper sill 10*f* and the fall-board 12. The hinge 14 offers an axis AX1 of rotation to the fall-board 12, and, accordingly, the fall-board 12 turns around the rotational axis AX1. The flexible couplings 13 are a kind of the Oldham's coupling, and provide large margin to the alignment with the fall-board 12.

The fall-board 12 and the upper sill 10*f* are partially cut off, and the side surfaces 12*a* of the fall-board 12 and the side surfaces 10*fa* of the upper sill 10*f* are partially retracted. The flexible couplings 13 are attached between the retracted side surfaces 12*a*/10*fa* and the side arms 10*b*.

In this instance, the piano case structure 10 except for the upper sill 10*f* serves as a case, and the fall-board 12, the upper sill 10*f* and the hinge 14 as a whole constitute a fall-board assembly.

The flexible coupling 13 is broken down into a socket member 13*a*, a rotary damper 13*b* and a floating cum member 13*c*. The floating cum member 13*c* is engaged with the socket member 13*a* and the rotary damper 13*b*, and takes up misalignment between the rotational axis AX1 and axes of rotation AX2 of the rotary dampers 13*b*. Thus, the Oldham's coupling 13 makes the assembling work easy.

The socket member 13*a* has a boss portion 13*d* and a ring portion 13*e*. A pair of holes 13*f* is formed in the boss portion 13*d*, and the boss portion 13*d* is fixed to the retracted side surface 12*a* by means of screws 13*ga* and nuts 13*gb*. The ring portion 13*e* forms a circular recess 13*h*, and the circular recess 13*h* has a center axis AX3 aligned with the rotational axis AX1. The floating cum member 13*c* is slidably received in the circular recess 13*h*. A pair of projections 13*j* inwardly projects from the inner surface of the ring portion 13*e* into the circular recess 13*h*, and the projections 13*j* are spaced by 180 degrees. The ring portion 13*e* is partially cut away so as to form a channel 13*k*.

A cylinder 13*m* and a rotational member 13*n* form the rotary damper 13*b*. The cylinder 13*m* is embedded into the side arm 10*b*, and is fixed thereto by means of screws 13*p*. The rotary member 13*n* has an axis AX2 of rotation, and the rotational axis AX2 is aligned with the rotational axis AX1. A platelike projection 13*q* is formed on the end surface of the rotary member 13*n*, and has thickness less than the width of the channel 13*k*. For this reason, the plate-like projection 13*q* can pass the channel 13*k*. When the ring portion 13*e* is thin, the channel 13*k* may not be formed in the ring portion 13*e*.

Figure 5:
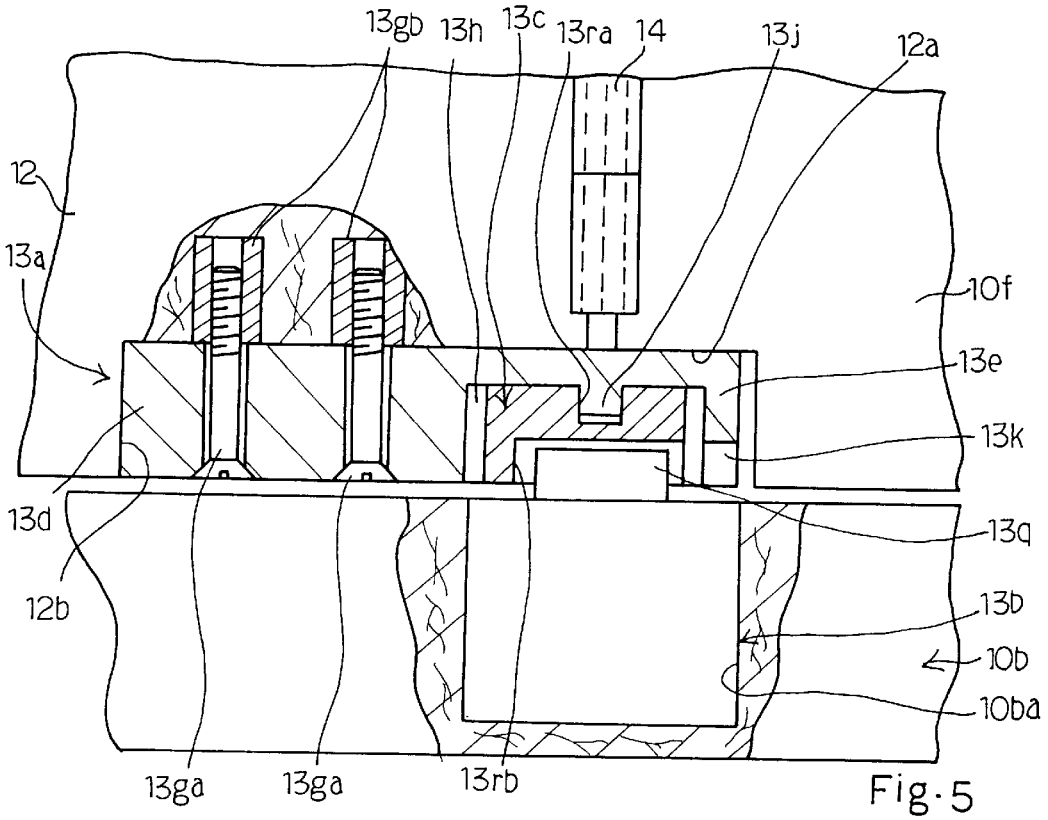
FIG. 5 is a partially cut-away plane view showing the flexible coupling inserted between the fall-board and a side arm.

The floating cum member 13*c* has a disk configuration, and has a diameter less than the diameter of the circular recess 13*h*. A pair of recesses 13*ra* is formed in one side surface of the floating cum member 13*c*, and a groove 13*rb* (see FIG. 5) is formed in the other side surface of the floating cum member 13*c*. The direction between the recesses 13*ra* is perpendicular to the longitudinal direction of the groove 13*rb*, and the direction between the recesses 13*ra* and the longitudinal direction cross a rotational axis AX4 of the floating cum member 13*c*. The distance between the bottom surfaces of the recesses 13*ra* and the circumference of the floating cum member 13*c* is greater than the distance between the top surfaces of the projections 13*j* and the inner surface of the ring portion 13*e*, and the projections 13*j* allows the floating cum member 13*c* to radially slide in the recesses 13*ra*. The groove 13*rb* is not seen in FIG. 3, and the plate-like projection 13*q* is loosely inserted into the groove 13*rb*. For this reason, even if the rotational axis AX1 is misaligned with the rotational axis AX2, the floating cum member 13*c* takes up the misalignment during the rotation of the fall-board 12.

Figure 6A:
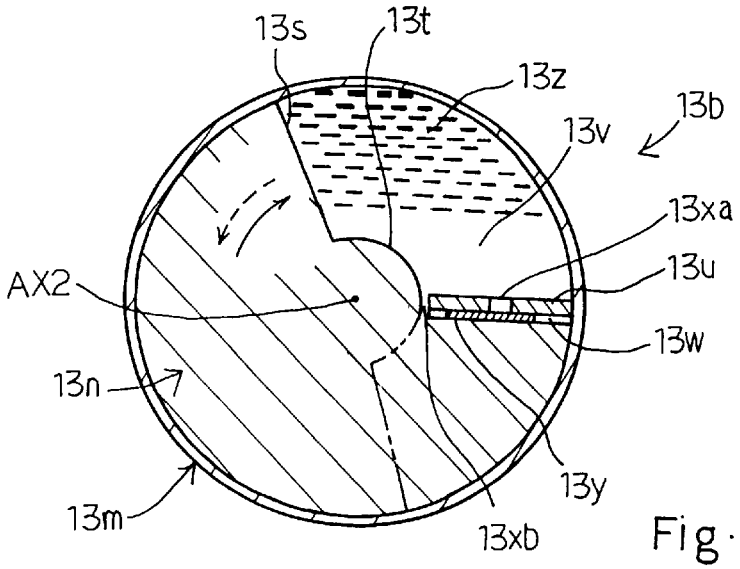
FIGS. 6A to 6C are cross sectional views showing the relative relation between a cylinder and a rotary member forming a rotary damper incorporated in the flexible coupling.
Figure 6B:
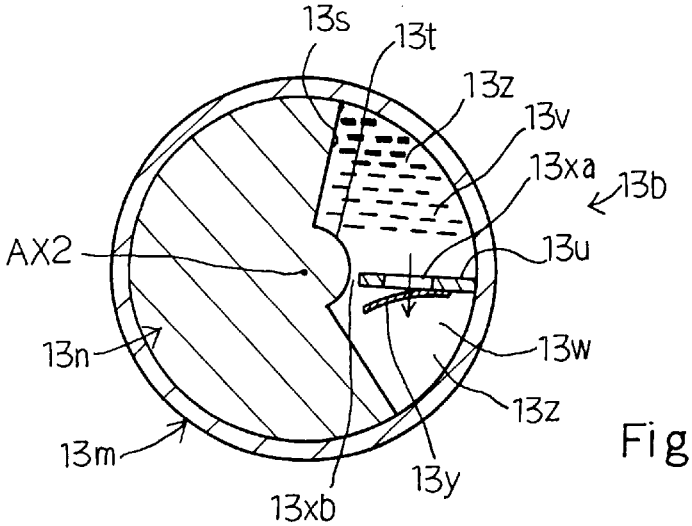
Figure 6C:
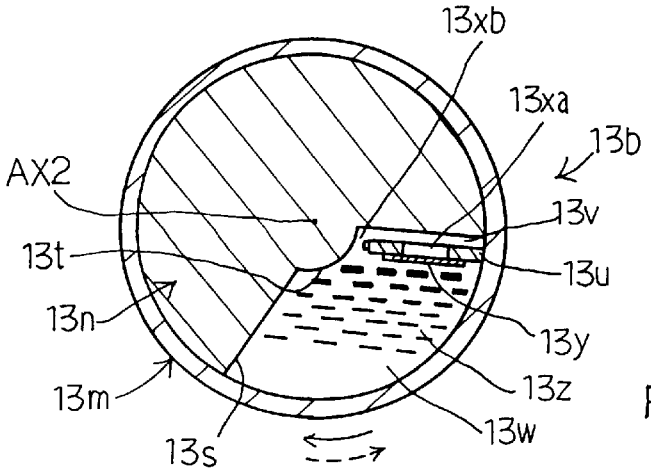

The rotary damper 13*b* is illustrated in FIGS. 6A to 6C in detail. The rotational member 13*n* has a generally sectorial groove 13*s*, and the generally sectorial groove 13*s* extends along the rotational axis AX2. The bottom surface 13*t* of the generally sectorial groove 13*s* is round. A partition wall 13*u* inwardly projects from the inner surface of the cylinder 13*m*, and the rotational member 13*n* is inserted into the inner space of the cylinder 13*m* in such a manner that the partition wall 13*u* splits the generally sectorial groove 13*s* into two chambers 13*v*/ 13*w*. A hole 13*xa* is formed in the partition wall 13*u*, and a check valve 13*y* is attached to the partition wall 13*x*. The partition wall 13*u* is slightly spaced from the bottom surface 13*t*, and a throttle 13*xb* is formed between the partition wall 13*u* and the bottom surface 13*t*. The generally sectorial groove 13*s* and, accordingly, the two chambers 13*v*/13*w* are filled with incompressible fluid 13*z* such as damping oil, and the cylinder 13*m* and the rotational member 13*n* seals the damping oil 13*z* in the chambers 13*v*/13*w*.

The throttle 13*xb* allows the damping oil 13*x* to bidirectionally flow between the two chambers 13*v* and 13*w*. However, the check valve 13*y* blocks the hole 13*xa* from the damping oil 13*z* flowing from the chamber 13*w* to the chamber 13*v*, and the damping oil 13*z* only flows through the hole 13*xa* from the chamber 13*v* to the chamber 13*w*. For this reason, when the damping oil 13*z* flows from the chamber 13*w* to the chamber 13*v*, the damping oil 13*z* flows only through the throttle 13*xb*, and is subjected to large viscous resistance. On the other hand, while the cylinder 13*m* and the rotational member 13*n* are relatively rotated as indicated by arrows in FIG. 6A, the check valve 13*y* opens the hole 13*xa* as shown in FIG. 6B, and the damping oil 13*z* flows through the hole 13*xa*. The hole 13*xa* merely offers negligible viscous resistance against the damping oil, and the cylinder 13*m* and the rotational member 13*n* are smoothly changed to the relative position shown in FIG. 6C. The chamber 13*v* is maximized in volume in the relative position shown in FIG. 6A, and is minimized in the relative position shown in FIG. 6C. On the other hand, the chamber 13*w* is maximized in volume in the relative position shown in FIG. 6C, and is minimized in the relative position shown in FIG. 6A. The minimum volume is approximately zero. Thus, the rotary damper 13*b* varies the viscous resistance depending upon the direction of the rotation. In this instance, the rotary damper 13*b* offers the large resistance during the rotation of the fall-board 12 from the open position to the closed position and the negligible resistance from the closed position to the open position.

The fall-board 12 is assembled with the piano case structure 10 as follows. First, the hinge 14 is connected to the front surface of the upper sill 10*f* and the rear surface of the fall-board 12. The fall-board 12 thus hinged with the upper sill 10*f* form in combination a fall-board assembly.

Subsequently, the rotary dampers 13*b* and the socket members 13*a* are attached to the side arms 10*b* and the retracted side surfaces 12*a*/10*fa*, respectively. Cylindrical recesses 10*ba* have been already formed in the side arms 10*b* (see FIG. 5), and the rotary dampers 13*b* are snugly received in the cylindrical recesses 10*ba*, respectively. The rotary dampers 13*b* are screwed to the side arms 10*b*, respectively. On the other hand, the retracted side surfaces 10*fa*/12*a* define side recesses 12*b*, and the socket members 13*a* are inserted into the side recesses 12*b*, respectively. The screws 13*ga* and the nuts 13*gb* fix the socket members 13*a* to the fall-board 12. The nuts 13*gb* have been already positioned at appropriate positions where the axis AX3 is aligned with the axis AX1, and the nuts 13*gb* serve as an alignment mark. Even if the fall-board assembly is disassembled from the piano case structure 10 at user's home, erectors easily align the fall-board assembly with the piano case structure 10 by using the screws 13*ga* and the nuts 13*gb*.

Subsequently, the floating cum members 13*c* are respectively inserted into the circular recesses 13*h*, and the projections 13*j* are engaged with the recesses 13*ra*. The erector turns the rotational members 13*n* so as to make the plate-like projections 13*q* become vertical. The erector holds the fall-board 12 vertical, and moves the fall-board assembly downwardly so as to insert the plate-like projections 13*q* through the channels 13*k* into the grooves 10*rb*, respectively. After the assemblage, a pianist is assumed to play a tune on the upright piano. The player lifts the front portion of the fall-board 12 so that the fall-board 12 turns from the closed position toward the open position. While the fall-board 12 is rotated, the damping oil 13*z* is forced to flow from the chamber 13*v* to the other chamber 13*w*. The damping oil 13*z* presses the check valve 13*y*, and the check valve 13*y* is spaced from the partition wall 13*u*. For this reason, the rotational members 13*n* are moved with small viscous resistance, and the player easily moves the fall-board 12 to the open position.

The player fingers on the keyboard 11, and plays the tune on the upright piano. After playing the upright piano, the player pulls down the front portion of the fall-board 12, and the fall-board 12 turns from the open position to the closed position. While the fall-board 12 is turning from the open position to the closed position, the damping oil 13*z* is forced to flow from the chamber 13*w* to the other chamber 13*v*. The check valve 13*y* is pressed against the partition wall 13*u*, and closes the hole 13*xa*. For this reason, the damping oil 13*z* flows the narrow throttle 13*xb*, and offers the large viscous resistance to the rotational members 13*n* and, accordingly, the fall-board 12. The viscous resistance is so large that the fall-board 12 gently reaches the closed position without impact against the key slip 10*d*.

As will be appreciated from the foregoing description, the flexible couplings 13 offer large margin between the rotational axis AX1 of the fall-board assembly and the rotational axes of the rotational members 13*n*, and make the assembling work easy. Even if the rotational axis AX1 is offset from the rotational axes of the rotary dampers, neither rotary dampers 13*b* nor the fall-board assembly are broken.

The Oldham's couplings 13*a*/13*c*/13*q* are economical rather than the pair of gears in total, because the assembling cost is drastically reduced. Thus, the flexible couplings 13 do not seriously increase the production cost of the upright piano.

Finally, the flexible couplings 13 take up the misalignment through the relative motion between the projections 13*j*/13*q* and the recesses/groove 13*ra*/13*rb*, and erectors easily assemble the fall-board 12 with the piano case structure 10. Especially, the nuts 13*gb* are embedded into the retracted side surfaces of the fall-board 12 at the positions where the axis AX1 is aligned with the axes AX3. For this reason, the erectors can attach the socket members 13*a* to the fall-board 12 without serious misalignment. Even if misalignment takes place, the Oldham's couplings 13*a*/13*c*/13*q* absorbs the misalignment. The Oldham's couplings are assembled only through the insertion of projections into the recesses/ groove, and the erectors easily assemble the fall-board 12 with the piano case structure 10 at user's home. The separation of the fall-board 12 from the piano case structure 10 is also easy.

Although a particular embodiment of the present invention has been shown and described, it will be apparent to those skilled in the art that various changes and modifications may be made without departing from the spirit and scope of the present invention.

For example, the projections 13*j* may be replaced with a single bar. In this instance, the floating cum member 13*c* has a single groove instead of the pair of recesses 13*ra*. The recesses/groove 13*ra*/13*rb* may be formed in the socket member 13*a* and the rotational member 13*n*. In this instance, the projections are formed in the floating cum member 13*c*.

If a fall-board is light, the chambers 13*v*/13*w* may be filled with the air instead of the damping oil.

A suitable stopper or a cover plate may be attached to the socket member 13*a* after the insertion of the floating cum member 13*c* into the circular recess 13*h* so as to prevent the floating cum member 13*c* from coming out.

The flexible couplings 13 may be used for an automatic player piano, a mute piano or an electronic keyboard musical instrument.

The rotary dampers 13*b* and the Oldham's couplings may be attached to the fall-board and the piano case, respectively.

What is claimed is:

1. A keyboard musical instrument comprising a case having an opening, a keyboard supported by said case and exposed to said opening, a fall-board assembly changed between an open position for exposing said keyboard to a player and a closed position for covering said keyboard, a pair of rotary dampers attached to one of said fall-board assembly and said case and offering resistance against a rotating motion of said fall-board assembly from said open position to said closed position, and a flexible coupling including a pair of Oldham's couplings connected between the other of said fall-board assembly and said case and said pair of rotary dampers.

2. The keyboard musical instrument as set forth in claim 1, in which said pair of Oldham's couplings has a first axis of rotation aligned with a second axis of rotation of said fall-board.

3. The keyboard musical instrument as set forth in claim 1, in which each of said Oldham's couplings has a first member attached to said other of said fall-board assembly and said case and formed with one of a slider and a guide space for allowing said slider to move therealong, a second member connected to the associated rotary damper and formed with one of said slider and said guide space arranged in perpendicular to said one of said slider and said guide space of said first member, and a floating member provided between said first member and said second member and formed with the other of said slider and said guide space associated with said first member and the other of said slider and said guide space associated with said second member.

4. The keyboard musical instrument as set forth in claim 3, in which said first member is attached to said fall-board assembly, and said second member is connected to a rotational member of said associated rotary damper.

5. The keyboard musical instrument as set forth in claim 4, in which said first member has a boss portion attached to said fall-board assembly and an engaging portion formed with said one of said slider and said space and projecting from said boss portion so as to align a first axis of rotation of said fall-board assembly with a second axis of rotation of said floating member.

6. The keyboard musical instrument as set forth in claim 1, in which said case is used for an acoustic upright piano, and has a pair of side arms connected through said flexible coupling to said fall-board assembly.

7. The keyboard musical instrument as set forth in claim 6, in which said rotary dampers are embedded into said side arms, respectively, and connected to said Oldham's couplings attached to both side surfaces of said fall-board assembly.

8. The keyboard musical instrument as set forth in claim 7, in which each of said Oldham's couplings has a first member attached to said other of said fall-board assembly and said case and formed with one of a slider and a guide space for allowing said slider to move therealong, a second member connected to the associated rotary damper and formed with said one of said slider and said guide space arranged in perpendicular to said one of said slider and said guide space of said first member, and a floating member provided between said first member and said second member and formed with the other of said slider and said guide space.

* * * * *